United States Patent [19]

Homberg et al.

[11] 4,032,732

[45] June 28, 1977

[54] OPERATING HANDLE FOR AN ENCAPSULATED SWITCHING APPARATUS

[75] Inventors: Heinz Homberg; Kurt Franke, both of Amberg, Germany

[73] Assignee: Siemens Aktiengesellschaft, Munich, Germany

[22] Filed: June 5, 1975

[21] Appl. No.: 584,010

[30] Foreign Application Priority Data

June 6, 1974 Germany ..... 2427314

[52] U.S. Cl. ..... 200/50 A

[51] Int. Cl.[2] ..... H01H 9/20

[58] Field of Search ..... 200/50 A, 329, 330, 200/42 T

[56] References Cited

UNITED STATES PATENTS

| | | | |
|---|---|---|---|
| 2,475,338 | 7/1949 | Rowe | 200/50 A |
| 2,512,505 | 6/1950 | Rowe | 200/50 A |
| 2,950,363 | 8/1960 | Bachman et al. | 200/50 A |
| 3,022,391 | 2/1962 | Oravec | 200/42 T X |
| 3,657,497 | 4/1972 | Homberg et al. | 200/50 A |

*Primary Examiner*—James R. Scott

*Attorney, Agent, or Firm*—Kenyon & Kenyon, Reilly, Carr & Chapin

[57] ABSTRACT

An operating handle for an encapsulated switching apparatus which includes a housing having a door and a stationary switching shaft. The handle is fastened to the door of the housing in a switched-on position of the apparatus by means of a spring-loaded shiftable locking plate which is shifted against the force of a loading spring in a switched-off position of the apparatus into a position in engagement with a stop member for releasing the switching shaft from the locking plate. The improvement comprises the stop member being formed by a resilient detent spring disposed within the operating handle, the restraining force of which can be overcome by an operating force applied to the handle.

4 Claims, 3 Drawing Figures

OPERATING HANDLE FOR AN ENCAPSULATED SWITCHING APPARATUS

BACKGROUND OF THE INVENTION

1. Field of the Invention

This invention relates generally to an operating handle for an encapsulated switching apparatus which includes a housing having a door and a stationary switching shaft, and in which the handle is fastened to the door of the housing in a switched-on position of the apparatus by means of a spring-loaded, shiftable locking plate which is shifted against the force of a loading spring in a switched-off position of the apparatus into a position in engagement with a stop member for releasing the switching shaft from the locking plate.

2. Description of the Prior Art

Operating handles of the above-described type are generally known in the art. See, for example, U.S. Pat. No. 3,757,497. The disadvantage of such operating handles, however, is that the turning range of the handle is limited to approximately 90° by a fixed stop member which shifts the locking plate of the handle and releases the switching shaft. It is, however, advantageous if a greater turning range is available so that, for example, the switching springs of the apparatus can be cocked while the locking of the handle to the shaft is in effect.

SUMMARY OF THE INVENTION

It is therefore an object of the present invention to overcome the aforementioned disadvantages of heretofore known operating handles and to provide an improved operating handle for an encapsulated switching apparatus of the above-described type having a greater angular turning range.

These and other objects of the invention are achieved in an operating handle for an encapsulated switching apparatus which includes a housing having a door and a stationary switching shaft. The handle is fastened to the door of the housing in a switched-on position of the apparatus by means of a spring-loaded, shiftable locking plate which is shifted against the force of a loading spring in a switched-off position of the apparatus into a position in engagement with a stop member for releasing the switching shaft from the locking plate. The improvement of the invention comprises the stop member being formed by a resilient detent spring which is disposed within the operating handle, and which has a restraining force which can be overcome by an operating force applied to the operating handle.

The detent spring may, in a preferred embodiment of the invention, comprise a spring clip having a projection which engages a recess provided in an annular section of a collar member surrounding the stationary switching shaft. The collar member surrounds a circular cover for the operating handle on the side of the collar member which faces the switching shaft. Such a spring clip may be installed in completely assembled operating handles simply and without modification if the stop member is formed by a portion of the spring clip which is bent at an angle of 90° with respect to the longitudinal axis of the clip, and, additionally, if the spring clip is disposed lengthwise in a plane extending transversely with respect to the switching shaft. The locking effect of the operating handle can be easily maintained if the cover member includes an edge member which is engaged with the bent portion of the spring clip so that after unlocking, the spring clip is shifted and returned to its original position.

These and other features of the operating handle constructed according to the invention will be described in further detail in the following detailed description.

BRIEF DESCRIPTION OF THE DRAWINGS

In the drawings, wherein similar reference numerals denote similar elements throughout the several views thereof.

DETAILED DESCRIPTION

Figure 1:
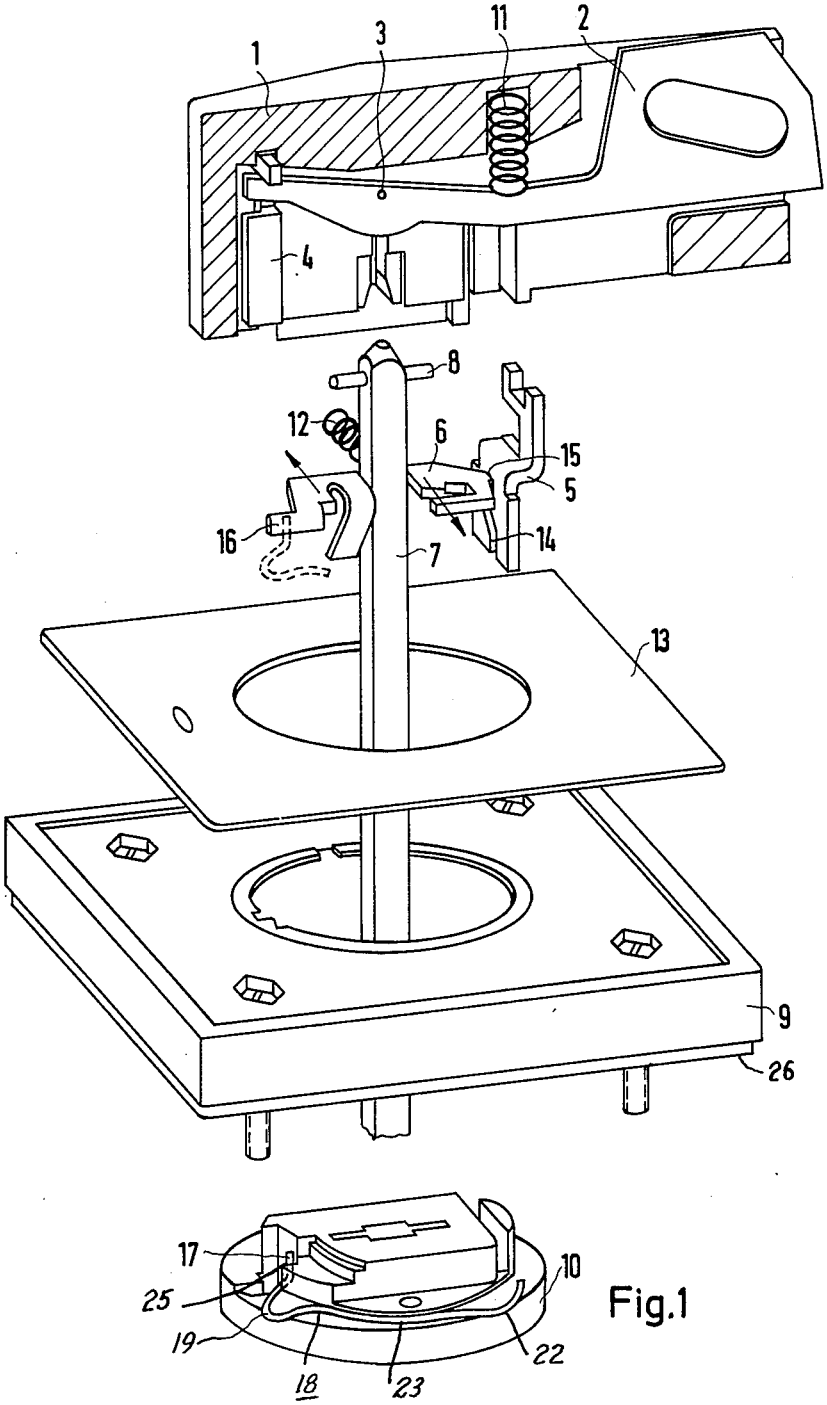
FIG. 1 is an exploded, perspective view, partially in section, of an improved operating handle constructed according to the invention.

Referring now to the drawings, there is shown an operating handle including a housing 1 in which a locking lever 2 is pivotably mounted about a pin 3. Lever 2 is disposed in engagement with a blocking element 4 and a control guide member 5, the latter of which actuates a locking plate 6 which locks the operating handle to the end of a switching shaft 7. A transverse pin 8 is provided at the end of shaft 7 for locking the shaft to the operating handle in conjunction with plate 6. The operating handle is fastened to a collar member 9, which may comprise part of the door of the housing, by means of a circular cover member 10. The switching apparatus actuated by the operating handle is not illustrated in the drawings. The control guide member 5 is disposed in engagement with one end of a coil spring 11, the other end of which is disposed in a recess provided in housing 1. One end of another coil spring 12 also engages the housing 1. The other end of spring 12 is in tangential connection with the locking plate 6. An indicating plate member 13 may be mounted to collar member 9 about switching shaft 7.

Control guide member 5 includes a control slot 14 in which an extension 15 of locking plate 6 is disposed. Slot 14 assures that the locking plate is shifted when locking lever 2 is pulled out of housing 1 of the operating handle. The blocking element 4 is mounted within the operating handle so that an outwardly extending appendage 16 of the locking plate 6 rests in engagement with the blocking element. The appendage 16 of plate 6 projects out of the plane of the locking plate so that it rests in engagement against a stop member 17 in the switched-off position of the apparatus. The stop member is formed by part of a spring clip 18 which protrudes through collar member 9, as shown in FIG. 1 by the dashed lines. Stop member 17 comprises part of the clip 18 which is bent in a direction parallel to the switching shaft 7 at an angle of approximately 90° with respect to the longitudinal axis thereof. A lateral projection 19 of the spring clip 18 is disposed in a recess 20 provided in an annular section 21 of collar member 9. As a result, locking plate 6 is first rotated by stop member 17 when the operating handle is moved so as to release the locking plate and permit the insertion of switching shaft 7. The shaft can also be removed from the locking plate in such a position without difficulty since a cut-out provided in locking plate 6 is positioned so as to permit the passage of pin 8 therethrough. Thus, in the off position of the apparatus and with locking lever 2 in its non-operational position, switching shaft 7 is not locked to the operating handle.

If, however, the operating handle is rotated through an angle of 90°, the stop member disengages from appendage 16, and the locking plate 6 pivots about the extension 15 thereof due to the force of spring 12. The transverse shaft pin 8 is then located behind the locking plate 6, and the door of the housing cannot be opened.

Figure 2:
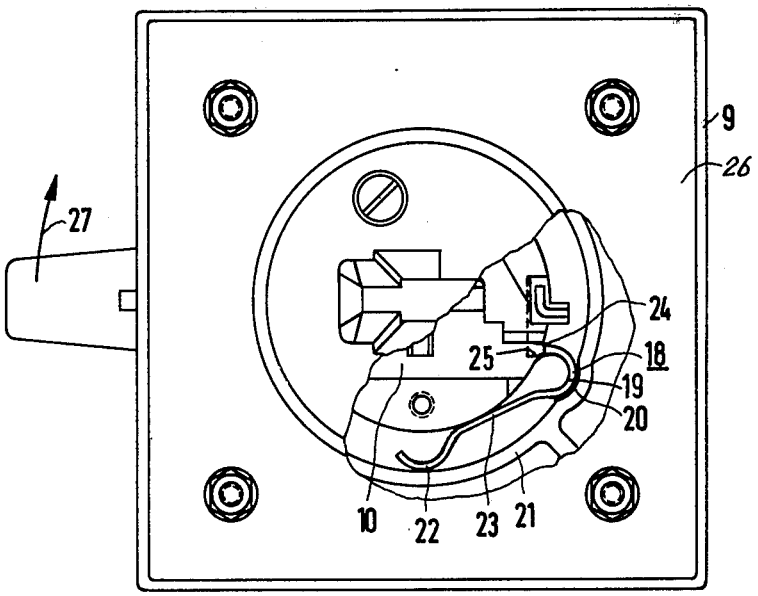
FIG. 2 is a bottom, plan view of the operating handle of the invention, shown in fully assembled condition with the switching shaft thereof removed, in the switched-off position of the switching apparatus.
Figure 3:
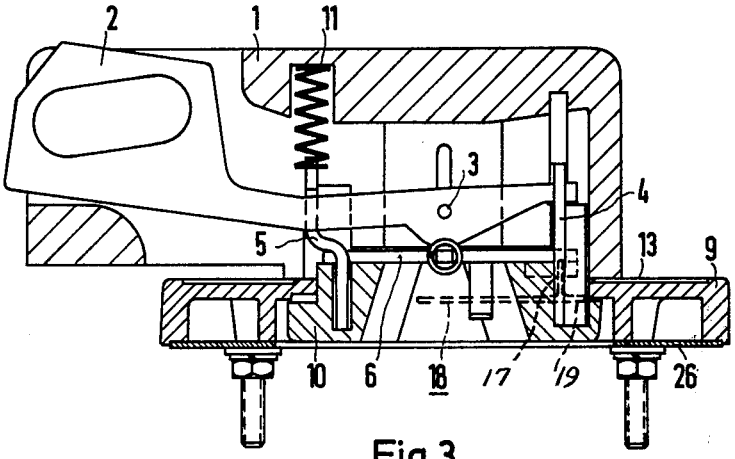
FIG. 3 is a partial, sectional side view of the operating handle illustrated in FIG. 2.

As is illustrated in FIG. 2, end 22 of spring clip 18 is disposed in engagement with section 21 of collar member 9. The center portion 23 of spring clip 18, in contrast, engages part of the cover member 10.

If the operating handle is turned further in the direction illustrated by arrow 27 in FIG. 2, i.e., beyond the switched-off position of the switching apparatus, stop member 17 is pushed out of its detent position by appendage 16 and is lifted out of recess 24 provided in the outer circumference of rotating cover 10. The position of the spring clip is accordingly shifted. As a result of the lifting of the stop member out of recess 24, spring clip 18 is returned to the position illustrated in FIG. 2 by an edge member 25 provided on cover member 10 when the operating handle is returned to its original position. In this manner, the spring clip does not interfere with the switching on of the switching apparatus. A cover plate 26 may be provided on the lower part of collar member 9 in order to protect the spring clip from external forces.

For further details of the construction and operation of the type of operating handle described herein, reference may be had to the aforementioned U.S. Pat. No. 3,657,497.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restictive sense.

What is claimed is:

1. In an operating handle for an encapsulated switching apparatus including a housing having a door and a stationary switching shaft, said handle being fastened to said door of said housing in a switched-on position of the apparatus by means of a spring-loaded, shiftable locking plate, said plate being shifted against the force of a loading spring in a switched-off position of said apparatus into a position in engagement with a stop member for releasing said switching shaft from said locking plate, wherein the improvement comprises said stop member being formed by a resilient detent spring disposed within said operating handle, the restraining force of which can be overcome by an operating force applied to said handle.

2. The operating handle recited in claim 1, further comprising a plate-shaped cover disposed about said shaft, a collar including an annular section surrounding said cover and including a recess, and wherein said spring comprises a clip spring having a projecting portion which is disposed in said recess of said annular collar section.

3. The handle recited in claim 2, wherein said stop member comprises part of said spring clip which is bent at an angle of approximately 90° with respect to the longitudinal axis thereof, said spring clip being disposed in said operating handle lengthwise in a plane extending transversely with respect to said switching shaft.

4. The handle recited in claim 3, wherein said cover includes an edge member engageable with said stop member, for shifting said spring clip after the release of said switching shaft from said locking plate.

* * * * *